US008267941B2

(12) United States Patent
Gao

(10) Patent No.: US 8,267,941 B2
(45) Date of Patent: Sep. 18, 2012

(54) ELECTRICAL DEPILATOR

(76) Inventor: Yong Gao, Guangdong Province (CN)

( * ) Notice: Subject to any disclaimer, the term of this patent is extended or adjusted under 35 U.S.C. 154(b) by 355 days.

(21) Appl. No.: 12/629,065

(22) Filed: Dec. 2, 2009

(65) Prior Publication Data

US 2010/0076458 A1 Mar. 25, 2010

Related U.S. Application Data

(63) Continuation-in-part of application No. PCT/CN2008/000860, filed on Apr. 28, 2008.

(30) Foreign Application Priority Data

Jul. 3, 2007 (CN) ..... 2007 2 0121277 U

(51) Int. Cl.
*A61B 17/50* (2006.01)

(52) U.S. Cl. ..... 606/133

(58) Field of Classification Search ..... 606/131, 606/133; 30/32, 34.2, 43.5–43.5; 452/75, 452/82–85

See application file for complete search history.

(56) References Cited

U.S. PATENT DOCUMENTS

| | | | | |
|---|---|---|---|---|
| 5,234,442 | A * | 8/1993 | Schafer et al. | 606/133 |
| 5,312,419 | A * | 5/1994 | Garenfeld et al. | 606/133 |
| 6,730,099 | B1 * | 5/2004 | Kreutz et al. | 606/133 |
| 6,824,546 | B1 * | 11/2004 | Yiu | 606/133 |
| 7,833,232 | B2 * | 11/2010 | You | 606/133 |
| 2007/0093853 | A1 * | 4/2007 | Poran | 606/133 |
| 2008/0195118 | A1 * | 8/2008 | Liu | 606/133 |

* cited by examiner

*Primary Examiner* — Elizabeth Houston

(57) ABSTRACT

An electrical depilator includes a main body (1) and a head (2) mounted on the main body. The head includes a hair-plucking assembly (20) mounted on a frame (7), and with a shell (16) covering thereon. The hair-plucking assembly includes a plurality of discs (11) and discs carriers (10), a transmission gear (9), and a bearing cover being fitted over an arcuate shaft (5) and rotating in sync. Each discs carrier bears one disc. Each disc has a substantially circular and continuous circumference (115), and an undulating surface (112). Upper portions (110) and lower portions (111) for grasping and removing hair are radially and alternately arrayed to configurate such undulating surface of the disc. The electrical depilator can steadily and smoothly removing hair at a speed increased at least 3 times.

14 Claims, 7 Drawing Sheets

ELECTRICAL DEPILATOR

This is a continuation-in-part of PCT international application No. PCT/CN2008/000860, filed Apr. 28, 2008.

BACKGROUND OF THE INVENTION

The present invention relates to a depilatory device for removal of unwanted hair, and especially to an electrical depilator for quickly, smoothly, and silently grasping and removing hair.

There are a variety of hair pluckers available in the market now, but generally it is a roller-typed depilator. The roller-typed depilator removed hair via open-closed meshing between static hair-plucker elements and dynamic hair-plucker elements. However, such kind of depilator is very complicated for manufacturing, inefficient for depilating, and especially noisy in operation.

Other depilatory devices were known in the art as one described in international publication No.: WO2006/081709 to Liu. The Liu's electrical depilator comprising of a main body, a motor, a reduction gear set, an arcuate shaft and a set of singlepieces. The arcuate shaft is supported on a shaft seat of the main body. A first stage gear of the reduction gear set meshes with the driving wheel of the motor, and a last stage gear is fixed on the single-piece which is located at the endmost portion. Each single-piece has a clipping surface and a supporting portion. The whole set of single-pieces are arranged in a manner that the clipping surfaces are opposite to each other. A clipping gap is formed between opposite surfaces of two single-pieces. The whole set of single-pieces are coupled together by fixing members so as to rotate synchronously. The whole set of single-pieces are fitted over the arcuate shaft all together. However, Liu's electrical depilator has some disadvantages. Firstly, the singlepiece is formed with three radiating blades radiating from the shaft hole at the centre thereof, and being spaced with an equal angle therebetween. Therefore, only the three lips of the blades instead of the whole circumference are used for depilating (or clipping surface). In other words, a couple of singlepieces with clipping surface opposite forms a clipping gap therebetween for depilating, but two adjacent couples cannot form a clipping gap. Furthermore, one face of the singlepiece is used for depilating, but the other face is used for being fixed with other couple of singlepieces. Accordingly, the depilator is not efficient and quick enough. Secondly, a set of singlepieces are fixed over the arcuate shaft instead of base pieces supporting clipping pieces, and singe-pieces are suffered directly with driving force from the reduction gear set and the pulling force for depilating as well. It will cause unstably movement of the singlepices sometimes, so that the depilator cannot remove hair smoothly, and the user will feel uncomfortable. It is easy to damage the singlepieces as well. Thirdly, the reduction gear set is straight tooth gear, which will cause unsteady movement. Finally, the reduction gear set and the endmost of the singlepiece are directly fitted with the shaft seat, which will cause big noisy in use of the depilator, and serious damage to the gear set, the endmost singlepiece, and the shaft seat.

Therefore, an improved electrical depilator is desired which overcomes the disadvantages of the prior art.

BRIEF SUMMARY OF THE INVENTION

A main object of the present invention is to provide an electrical depilator, which can quickly, smoothly, and silently grasping and removing hair.

To obtain the above object, an electrical depilator in the present invention comprises a main body and a head mounted on the main body. The head comprises a hair-plucking assembly, a frame, and a shell. The hair-plucking assembly is rotatably mounted on the frame and with the shell covering thereon. The hair-plucking assembly comprises an arcuate shaft, a plurality of discs and discs carriers, a gear set including a reduction gear and a transmission gear engaged with each other, and a bearing cover. The discs, disc carriers, the transmission gear and the bearing cover are fitted over the arcuate shaft and rotate in sync. Each discs carrier bears one disc. Each disc substantially has a circular and continuous circumference, and an undulating surface. Upper portions and lower portions for grasping and removing hair are radially and alternately arrayed to configurate such undulating surface of the disc. Since both the upper portions and lower portions as clipping surfaces contribute to form traps between adjacent discs for depilating hair, the amount and size of the clipping surface of the invention increases at least twice than the one in the art, for example, than the Liu' depilator in WO2006/081709, so does the depilating speed. The rotation force from the gear set is imparted to the disc carriers instead of discs, so that the discs can rotate steadily and remove hair smoothly.

The upper portions at a front surface are accordingly as the lower portions at a back surface of the disc. A juncture between the adjacent upper portion and lower portion is a slope. A front view of the disc is substantially a circle with a shaft hole at the centre thereof, and three pairs of upper portions and lower portions are alternately arranged on the surface of the disc. Such symmetrical structure of the disc imparts a steady and balanceable rotation during operation.

A juncture from the shaft hole to the upper and lower portions forms a flattened plate in a shape of a polygon, which facilitates a stable structure of the discs and close engagement with the disc carrier.

The disc carriers comprise a support plate with a shaft sleeve at the centre for bearing one disc thereover. The support plate radially extends to form legs according to the lower portions of the disc. Each leg supports one lower portion. Each leg of the disc carrier forms a pinchers on a surface thereof for pressing against the lower portion of the disc. A pair of lips is formed at an end of each leg, wherein the lips are smooth, and impart comfortable touch and massage to the human skin surface during depilating.

In a preferable embodiment of the present invention, the disc carrier is formed with a triangle-like plate, which is intimately engaged with a hexagon-shaped flattened plate of the disc. Pairs of engagement protrusion and recession are equally lodged along the cylindrical inwall of the shaft sleeve, which are engaged with each other between two adjacent disc carriers, or between the disc and the bearing cover or the transmission gear in a gear-like fashion. There are three legs are radiated from the centre of the sleeve, located at a concentric circle and oriented approximated 120° apart from each. Such structure of the disc carrier facilitates a reliable fixture of the hair-plucking assembly, and smooth and steady rotation thereof.

The transmission gear has slope teeth, and forms a circular groove inside the gear for lodging a ball bearing. The ball bearing holds a plurality of balls, which presents a rolling engagement between the transmission gear and the frame. The bearing cover forms a circular groove at an end for lodging a ball bearing, which presents a rolling engagement between the bearing cover and the frame, too. Thereby, the electrical depilator of the present invention makes little noise in operation.

Other objects, advantages and novel features of the invention will become more apparent from the following detailed description of a preferred embodiment thereof when taken in conjunction with the accompanying drawings, wherein:

DETAILED DESCRIPTION OF THE INVENTION

Figure 1:
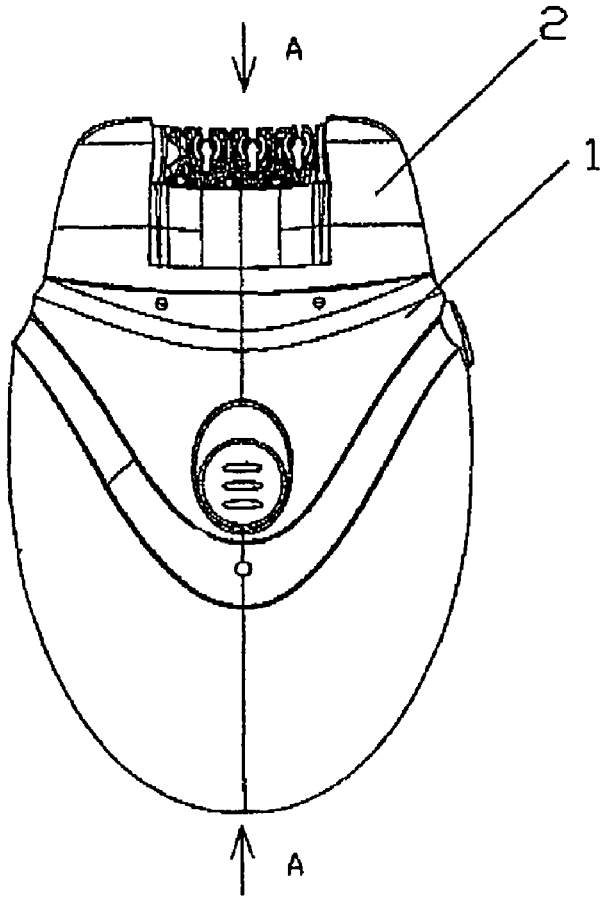
FIG. 1 is a perspective view of an electrical depilator in accordance with an embodiment of the present invention.
Figure 2:
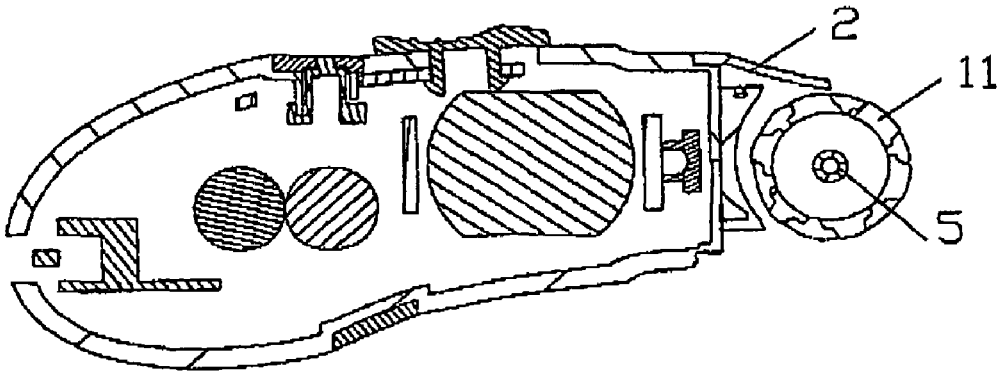
FIG. 2 is a cross-sectional view along line A-A of FIG. 1.

Referring to FIGS. 1 and 2, an electrical depilator according to the embodiment of the present invention includes a main body 1 and a head 2. The main body 1 includes a motor and hair box (not shown) therein, a desirable shape of which facilitates easy and comfortable gripping by one hand of the user. The head 2 is used to remove the unwanted hair, which is mounted on the body 2 and is driven by the motor therein. The motor may be operated by any convenient and available power source such as a battery or house current via a DC adaptor.

Figure 3:
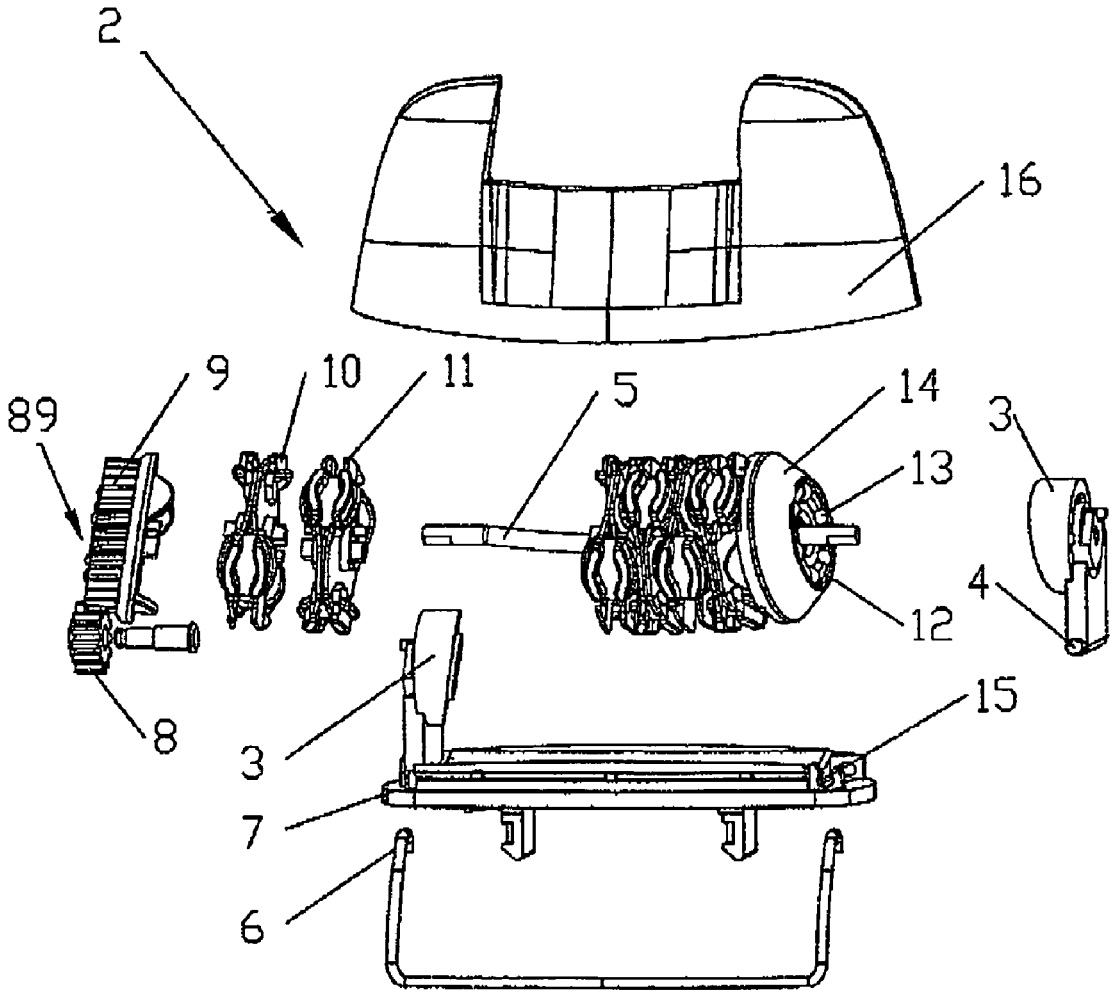
FIG. 3 is an exploded, perspective view of part of the electrical depilator of the present invention.
Figure 4:
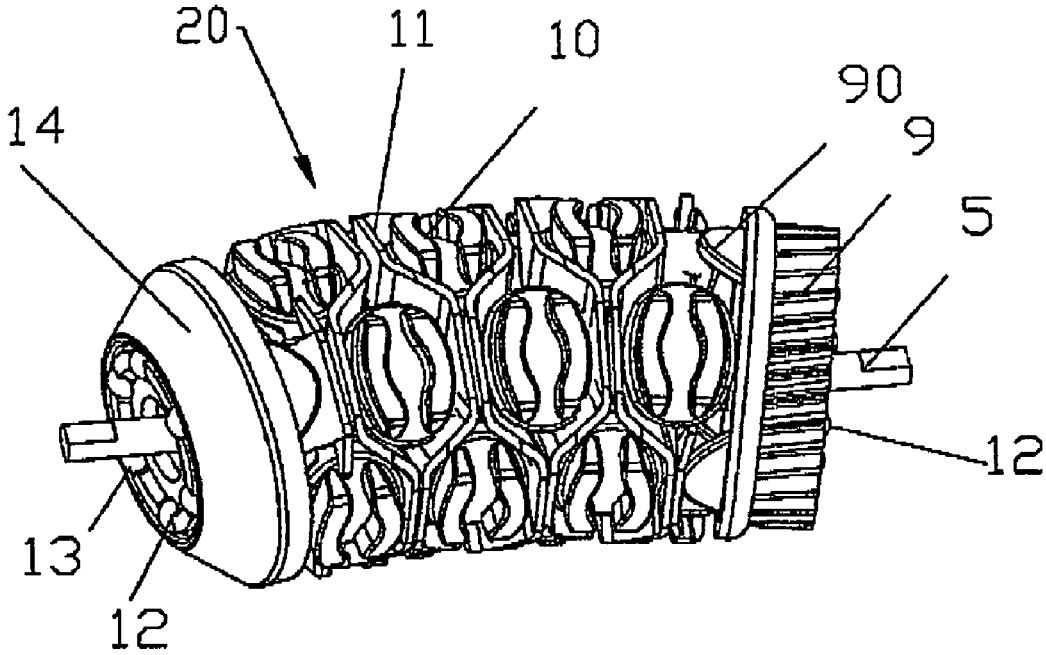
FIG. 4 is an assembled, perspective view of the hair-plucking assembly of the present invention.

Referring to FIGS. 3 and 4, the head 2 includes a hair-plucking assembly 20, a frame 7, a steel clip 6, and a shell 16. The hair-plucking assembly 20 is rotatably installed to the frame 7, the steel spring 6 clips at both ends of the frame 7, and the shell 16 covers thereon. The hair-plucking assembly 20 includes a gear set 89, a plurality of disc carriers 10, a plurality of discs 11, and a bearing cover 14, which are respectively fitted over an arcuate shaft 5 and rotate in sync.

The frame 7 includes a pair of shaft seats 3. At least one shaft seat 3 can be removable from the frame 7, and can be mounted thereto when a hinge 4 of the shaft seat 3 is secured in a pair of holes 15 at one end of the frame 7, so that the arcuate shaft 5 can be rotatably mounted into the pair of shaft seats 3.

Figure 8:
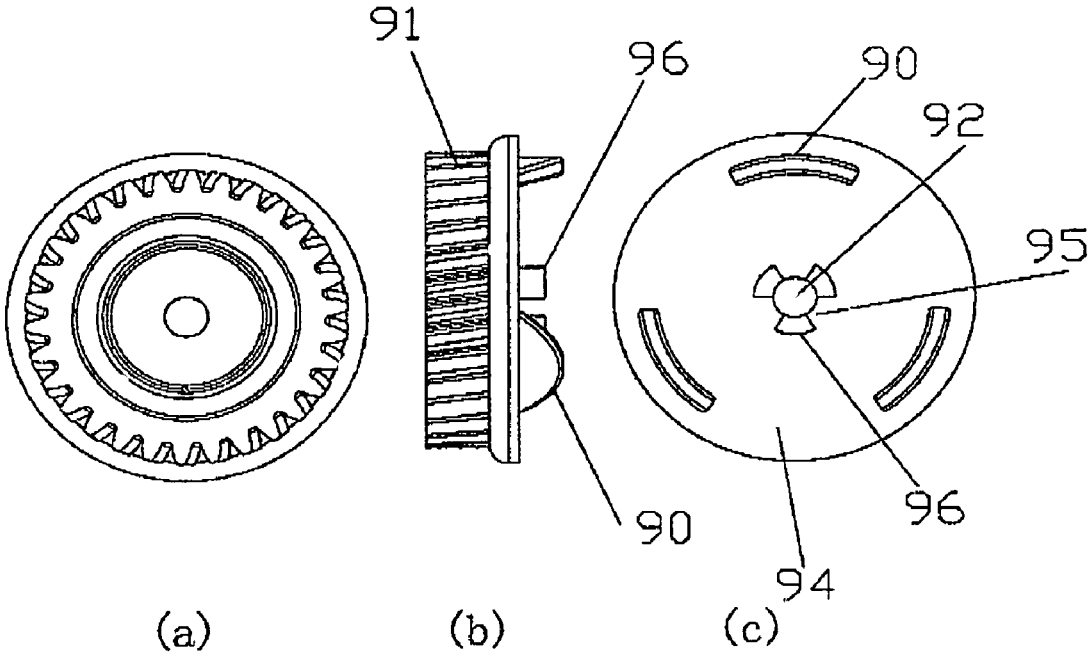
FIG. 8 is a front view, side view and back view of one element of the electrical depilator of the present invention.
Figure 9:
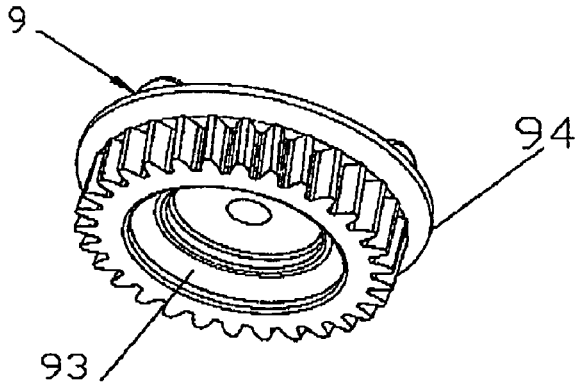
FIG. 9 is a perspective view of FIG. 8.

The gear set 89 includes a reduction gear 8 and a transmission gear 9 meshed with each other. The reduction gear 8 is driven by a driving shaft (not shown) of the motor in the main body 1. The transmission gear 9 is a bevel gear with slope teeth 91 thereon, as shown in FIG. 8 (*a*)(*b*)(*c*) and FIG. 9. There are three projections 90 (but not limited to three) set along a periphery at the back of a support plate 94 of the transmission gear 9. The three projections 90 are equally apart from one another. A shaft hole 92 is formed at the centre of the support plate 94. Three pairs (but not limited to three) of engagement protrusion 96 and recession 95 are formed along the hole 92. The transmission gear 9 defines a circular groove 93 for lodging a ball bearing 12 therein, as shown in FIGS. 3 and 4.

Figure 10:
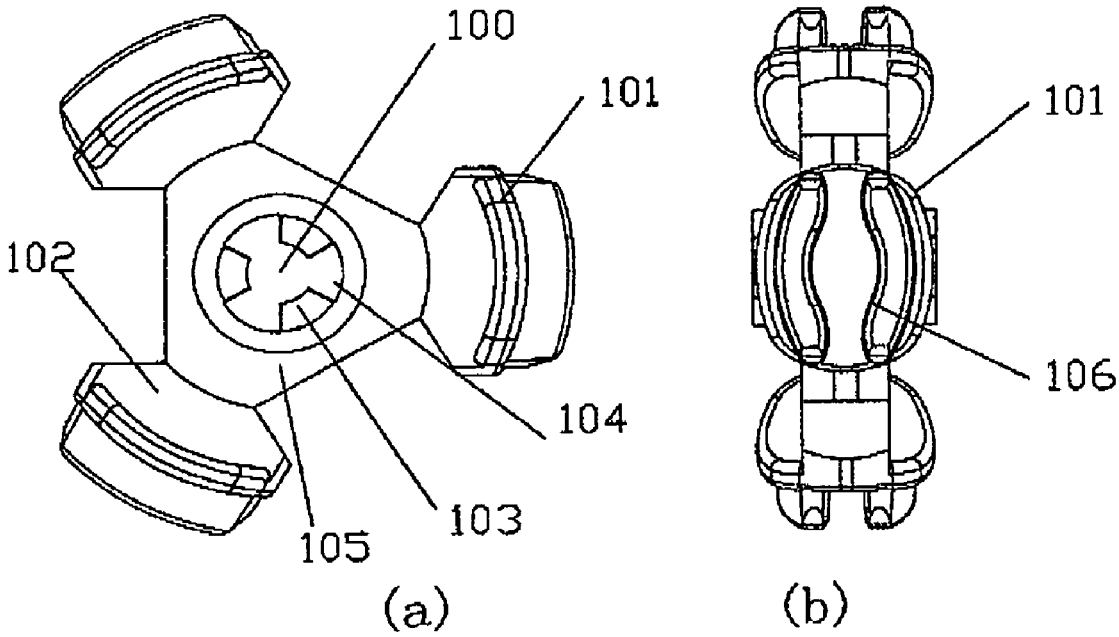
FIG. 10 is a front view and side view of one element of the electrical depilator of the present invention.
Figure 11:
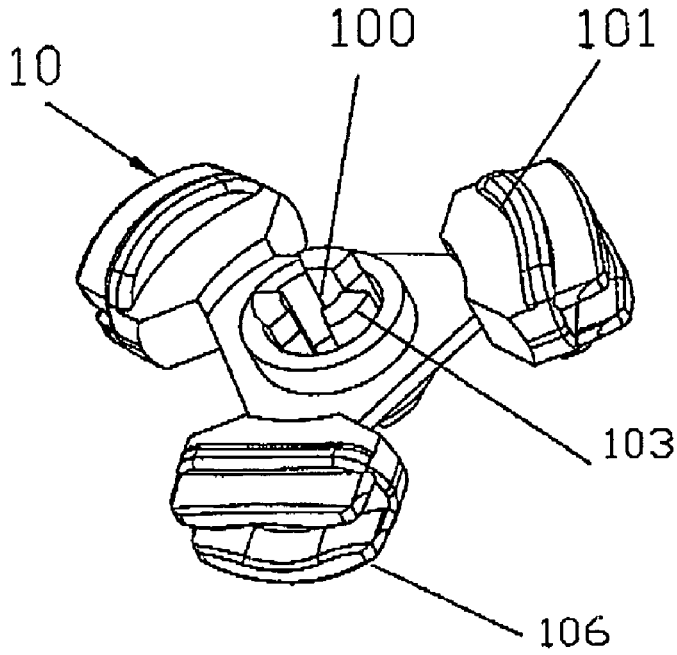
FIG. 11 is a perspective view of FIG. 10.

The disc carrier 10 in a preferable embodiment, as shown in FIG. 10(*a*)(*b*) and FIG. 11, has a support plate 105 substantially in a shape of triangle with three cut angles. A shaft sleeve 100 is formed at the centre of the same. Three pairs (but not limited to three) of engagement protrusion 103 and engagement recession 104 are equally lodged along the cylindrical inwall of the shaft sleeve 100. The three cut angles of the plate 105 respectively extend to form three legs 102, while the three legs 102 are radiated from the centre of the sleeve 100, are located at a concentric circle and oriented approximated 120° apart from each. Each leg 102 forms a pinchers 101 on both support surfaces (not labeled) thereof. A pair of lips 106 and a groove (not labeled) therebetween are formed at the end of each leg 102. The lips 106 are smooth and impart comfortable touch and massage to the human skin surface during depilating. Additionally, the groove means less weight and materials.

Figure 12:
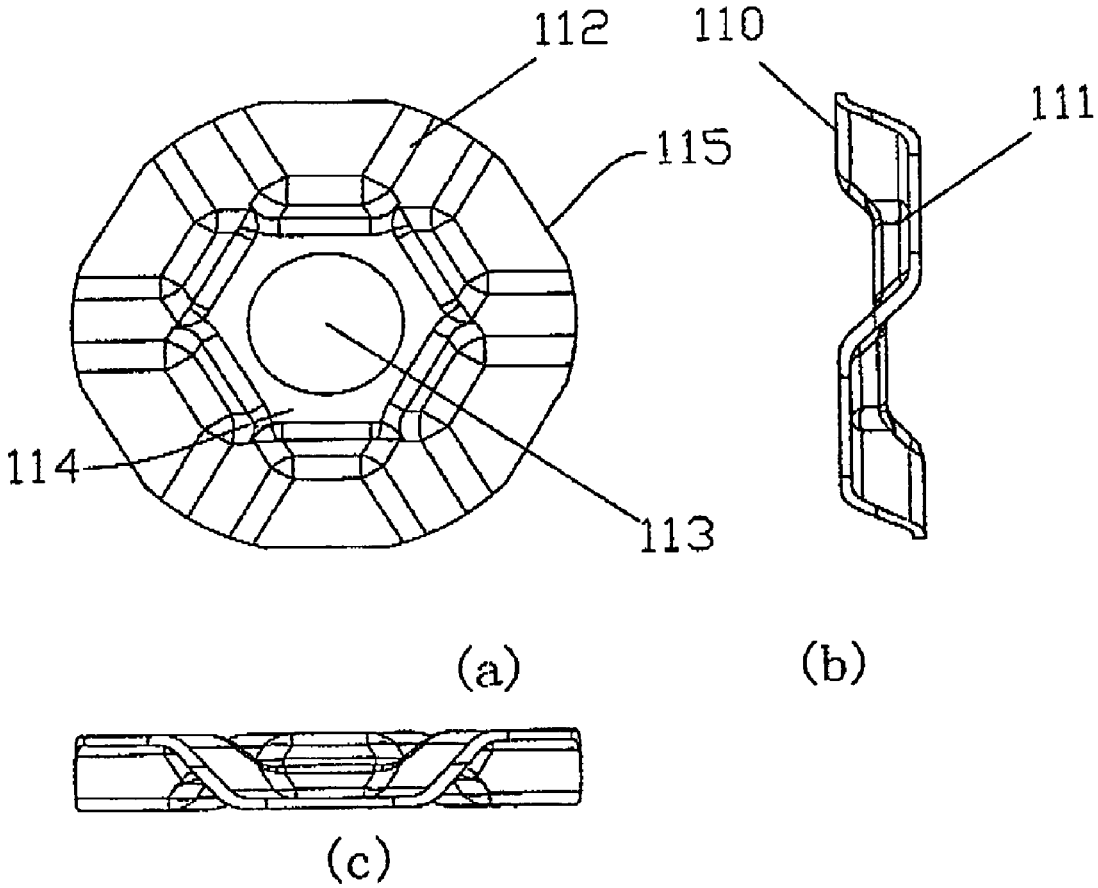
FIG. 12 is a front view, side view, and top view of one element of the electrical depilator of the present invention.
Figure 13:
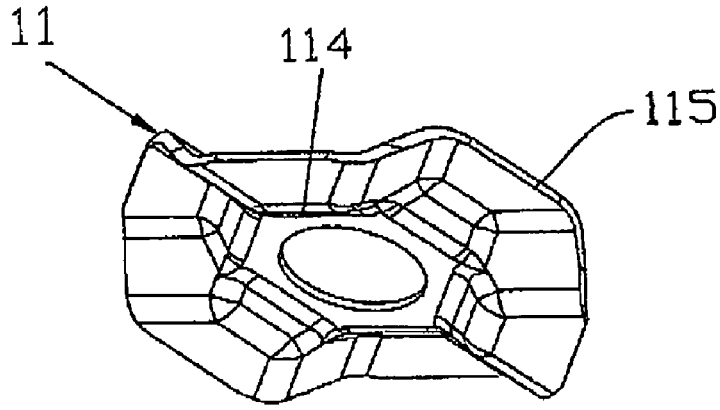
FIG. 13 is a perspective view of the FIG. 12.

Referring to FIG. 12(*a*)(*b*)(*c*) and FIG. 13, each disc 11 is preferably a thin and circular plate made of steel. It has a substantially circular and continuous circumference 115, and an undulating surface 112 with a shaft hole 113 at its centre. Upper portions 110 and lower portions 111 are alternately and radially arrayed to configurate such undulating surface 112. The upper portion 110 at the front surface is accordingly as the lower portion 111 at the back surface of the disc 11. The end circumferences of the upper 110 and lower portion 111 have an equal radius, thus the front view of the disc 11 shows a circle with a shaft hole at the centre, as shown in FIG. 12(*a*). The juncture between the adjacent upper portion 110 and lower portion 111 is preferably a slope. The juncture from the shaft hole 113 to the upper and lower portions 110, 111 forms a flattened plate 114 in a shape of a polygon, such as a hexagon. In a preferable embodiment of the present invention, three pairs of upper portion 110 and a lower portion 111 are alternately arranged on the surface 112, and contribute to grip and remove hair together.

Figure 5:
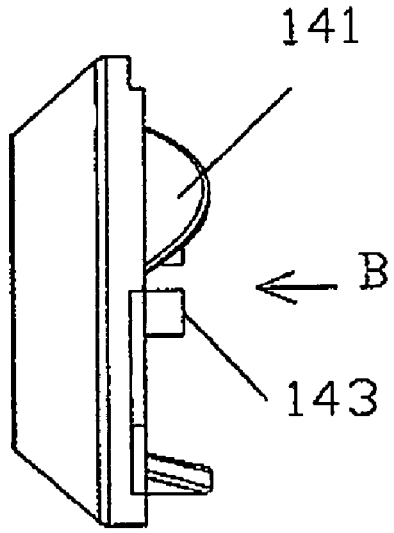
FIG. 5 is a side view of one element of the electrical depilator of the present invention.
Figure 6:
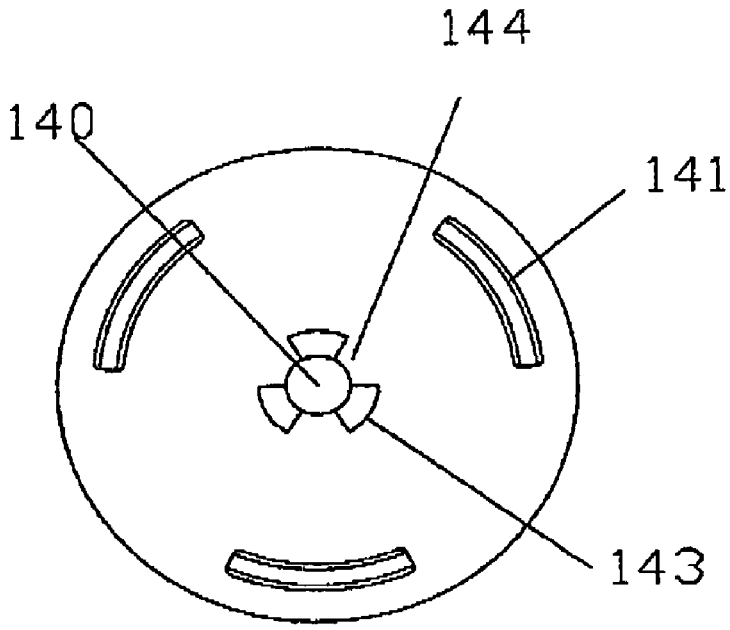
FIG. 6 is a front view from the direction B of FIG. 5.
Figure 7:
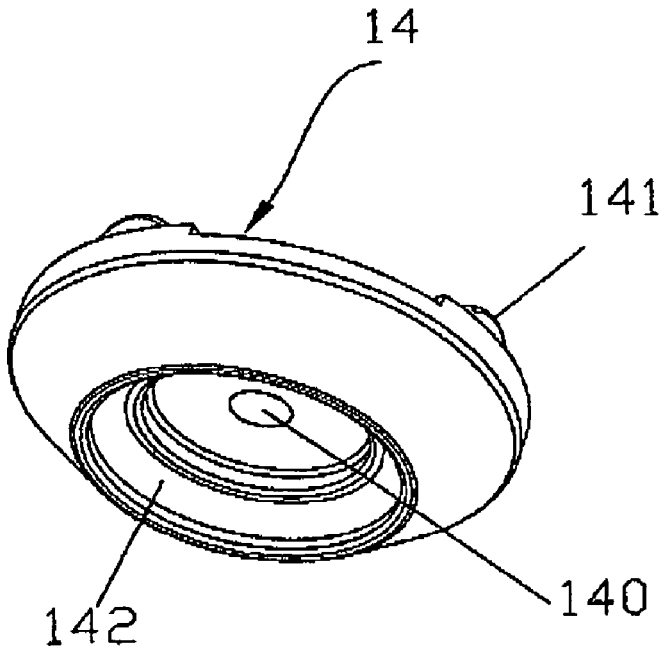
FIG. 7 is a perspective view of the element of FIG. 5.

Referring to FIGS. 5-7, the bearing cover 14 has a shape of cone. A shaft hole 140 is formed at its centre. Three pairs (but not limited to three) of engagement protrusion 143 and recession 144 are set along the hole 140. There are three (but not limited to three) projections 141 set along a periphery at a bottom of the cone 14, and equally apart from each other. A circular groove 142 is formed at top of the cone 14 for lodging the ball bearing 12, as shown in FIGS. 3 and 4.

Referring to FIG. 4 again, a plurality of discs 11 and disc carriers 10 are fitted over the arcuate shaft 5. Each disc carrier 10 bears one disc 11 in such a manner that shaft sleeve 100 and protrusions 103 of the carrier 10 insert through the shaft hole 113 of the disc 11. Therein, each leg 102 of the carrier 10 supports the lower portion 111 of the disc 11 with the pinchers 101 against the same. The support plate 105 is located in the flattened plate 114 of the disc 11. The arcuate shaft 5 is inserted into the shaft hole 100 of the disc carriers 10. The engagement protrusions 103 of the disc carrier 10 are inserted into the engagement recessions 104 of the adjacent disc carrier 10 in a gear-like fashion, so that each set of disc carrier 10 with one disc 11 can rotate in sync. Traps are formed between two adjacent discs 11 for gripping and removing hair at both the upper portions 110 and lower portions 111 of the disc 11. The bearing cover 14 and gear set 89 are mounted at either end of the arcuate shaft 5 while the arcuate shaft 5 is inserted in the shaft holes 140 and 92 thereof. The projections 90 at the back plate 94 of the transmission gear 9 and the projections 141 at the bottom of the bearing cover 14 press against the surface of the endmost disc 11 or disc carrier 10. Engagement projections 143 and recessions 144 at the center of the bearing cover 14, and the engagement projections 96 and recessions 95 of the transmission gear 9 are respectively engaged with the projections 103 and recessions 104 of the disc carriers 10 in a gear-like fashion, so that they can rotate in sync. Therefore, the transmission gear 9 converts the rotational speed to drive discs 11 of the depilator. The ball bearing 12 holds a plurality of balls 13 therein. Each ball bearing 12 is respectively lodged in the circular groove 142 of the bearing cover 14 and in the circular groove 93 of the transmission gear 9. Thereafter, the hair-plucking assembly 20 is assembled. Then the hair-plucking assembly 20 is mounted to the frame 7. The two ends of the arcuate shaft 5 are rotatably lodged in the two opposite shaft seats 3. Herein, the bearing cover 14 and the transmission gear 9 are respectively engaged with the shaft seat 3 via the rolling balls 13 in the grooves 142 and 93. The steel clip 6 is clipped at each end of the shaft seats 3. Finally, the shell 16 covers over the frame 7 so that the shell 16 holds the hair-plucking assembly 20 therein. Thereafter, the head 2 is assembled. Finally, the electrical depilator of the present invention as shown in FIG. 1 is available after the head 2 is mounted on the body 1.

In operation, when the electrical depilator of the present invention as shown in FIG. 1 is turned on via on/off switch (not labeled), the motor is activated and imparts rotational force to reduction gear 8 via a motor shaft (not labeled), which, in turn, imparts rotational force to the transmission gear 9. The transmission gear 9 rotates and drives the endmost disc carrier 10 via the engagement in a gear-like fashion between protrusions 96, 103 and recessions 95, 104 each other. The gear 9 drives the arcuate shaft 5 at the same time, and may drive the disc 11 via the projections 90 as well. Therefore, the hair-plucking assembly 20 can rotate with the arcuate shaft 5 in sync via the engagement in a gear-like fashion between protrusions 96, 103, 143 and recessions 95, 104, 144 each other. Thereby, the discs 11 on the gradually-narrowed side of the arcuate shaft 5 are caused to perform a clipping action for depilating hair, and those on the gradually widened side of the arcuate shaft 5 perform a loosening action for leaving the removed hair in the hair box and for picking up new hair on the skin again. Thus, hairs are depilated quickly on the gradually narrowed side of the arcuate shaft directly by use of the traps formed between upper or lower portions 110, 111 of adjacent discs 11, so as to depilate hairs quickly.

The clipping surface for depilating hair of the electrical depilator of the present invention is at least twice than the one in the art, for example, than the Liu' depilator in WO2006/081709, since the three pairs of upper portion 110 and lower portion 111 of each disc 11 are used as clipping surface for depilating hair. Each pair of lips 106 on the disc carrier 10 imparts comfortable touch and massage to the human skin surface during depilating. The rotation force from the gear set 89 is imparted to the disc carriers 10 instead of discs 11, and further using a transmission gear 9 with slope teeth, so that the discs 11 can rotate steadily and remove hair smoothly. Finally, the hair-plucking assembly 20 is engaged with the shaft seats 3 via rolling balls 13 in the ball bearing 12, which reduces noise in operation of the depilator.

It is understood that the undulating circular surface 112 of the disc 11 can forms more upper portions 110 and lower portions 111 instead of three pairs, accordingly, the amount of legs 102 of each disc carrier 10 is more than three. Thereby, traps for clipping hair between adjacent discs 11 forms small size, and each grips less hair, which alleviates pain of the user.

While the invention has been described in conjunction with specific embodiments, it is evident that numerous alternatives, modifications, and variations will be apparent to those skilled in the art in light of the forgoing descriptions. The scope of this invention is defined only by the following claims.

What is claimed is:

1. An electrical depilator comprising:

a main body; and a head mounted on the main body;

wherein said head comprises a hair-plucking assembly, a frame, and a shell; the hair-plucking assembly is rotatably mounted on the frame and with the shell covering thereon; the hair-plucking assembly comprises an arcuate shaft, a plurality of discs and discs carriers, a gear set including a reduction gear and a transmission gear engaged with each other, and a bearing cover, while the discs, disc carriers, the transmission gear and the bearing cover are fitted over said arcuate shaft and rotate in sync; each discs carrier bears one disc; each disc has a substantially circular and continuous circumference, and an undulating surface; upper portions and lower portions for gripping and removing hair are alternately and radially arrayed to configurate such undulating surface, said upper portions at a front surface is accordingly as the lower portions at a back surface of the disc, the end circumferences of the upper and lower portions have an equal radius, thus the front view of the disc shows a circle with a shaft hole at the centre; a juncture between the adjacent upper portion and lower portion is a slope, a juncture from the shaft hole to the upper and lower portions forms a flattened plate in a shape of a polygon with said shaft hole at the centre, which facilitates a stable structure of the disc and close engagement with said disc carrier; both the upper portions and lower portions as clipping surfaces contribute to form traps between adjacent discs for depilating hair.

2. The electrical depilator according to claim 1, wherein said disc carriers, transmission gear and bearing cover respectively form a shaft hole or sleeve at the centre thereof; and pairs of engagement protrusion and recession are formed along said shaft hole or sleeve, which are engaged in a gear-like fashion with each other.

3. The electrical depilator according to claim 2, wherein each disc carrier comprises a support plate with said shaft sleeve at the centre; said support plate radially extends to form legs according to the lower portions of each disc; and each leg supports one lower portion.

4. The electrical depilator according to claim 3, wherein each leg of said disc carrier forms a pinchers on a surface thereof for pressing against said lower portion of the disc; a pair of lips are formed at an end of each leg; the lips are smooth, and impart comfortable touch and massage to the human skin surface during depilating.

5. The electrical depilator according to claim 4, wherein said support plate has a shape of triangles with three cut angles; the three cut angles respectively extend to form three legs, while the legs are radiated from the centre of the shaft sleeve, located at a concentric circle and oriented 120° apart from each.

6. The electrical depilator according to claim 2, wherein said transmission gear has slope teeth; said transmission gear and said bearing cover respectively form a circular groove at an end for lodging a ball bearing therein, the ball bearing holds a plurality of balls, which respectively presents said transmission gear and bearing cover a rolling engagement with said frame, whereby the electrical depilator makes little noise in operation.

7. The electrical depilator according to claim 1, wherein there are three pairs of upper portions and lower portions alternately arranged on the surface of the disc, and the flattened plate of the disc has a shape of a hexagon.

8. A hair-plucking assembly comprising:

a plurality of discs; and a plurality of disc carriers, each bearing one disc thereon and being fitted over an arcuate shaft; wherein each set of disc carrier and disc is engaged with each other over the arcuate shaft, and rotates in sync; said disc is a thin and circular plate with an undulating surface; upper portions and lower portions for grasping and removing hair are alternately and radially arranged to form such undulating surface of the disc; said upper portions at a front surface is accordingly as the lower portions at a back surface of the disc; the end circumferences of the upper and lower portions have an equal radius, thus the front view of the disc shows a circle with a shaft hole at the centre; a juncture from the shaft hole to the upper and lower portions forms a flattened plate which facilitates a stable structure of the disc and close engagement with said disc carrier; each disc carrier comprises a support plate with a shaft sleeve at the centre, said support plate radially extends to form legs according to the lower portions of each disc, and each leg supports one lower portion; the support plate of the disc carrier is located in the flattened plate of the disc; both the upper portions and lower portions as clipping surfaces contribute to form traps between adjacent discs for depilating hair.

9. The hair-plucking assembly according to claim 8, wherein a juncture between the adjacent upper portion and lower portion is a slope.

10. The hair-plucking assembly according to claim 8, wherein there are three pairs of upper portion and lower portion alternately arranged on the surface of the disc; and the flattened plate of the disc has a shape of a polygon.

11. The hair-plucking assembly according to claim 8, wherein each leg of said disc carrier forms a pinchers on a surface thereof for pressing against said lower portion of the disc; a pair of lips are formed at an end of each leg; the lips are smooth, and impart comfortable touch and massage to the human skin surface during depilating.

12. The hair-plucking assembly according to claim 11, wherein said support plate of the disc carrier is formed with a shaft sleeve at the centre; pairs of engagement protrusion and recession are lodged along a cylindrical inwall of the shaft sleeve, which are engaged in a gear-like fashion between two adjacent disc carriers.

13. The hair-plucking assembly according to claim 12, wherein said support plate has a shape of triangles with three cut angles; the three cut angles respectively extend to form three legs, while the legs are radiated from the centre of the shaft sleeve, located at a concentric circle and oriented 120° apart from each.

14. The hair-plucking assembly according to claim 8, further comprising a transmission gear with slope teeth, and a bearing cover, wherein the transmission gear and bearing cover respectively hold a ball bearing therein, are fitted over the arcuate shaft at either end of the same, and are engaged with the endmost disc carrier in a gear-like fashion for a synchronous rotation.

* * * * *